US007419423B1

(12) United States Patent
Reeves, Sr.

(10) Patent No.: US 7,419,423 B1
(45) Date of Patent: Sep. 2, 2008

(54) SANDING BLOCK

(75) Inventor: James R. Reeves, Sr., Cheshire, CT (US)

(73) Assignee: J. R. Reeves Company, Cheshire, CT (US)

( * ) Notice: Subject to any disclaimer, the term of this patent is extended or adjusted under 35 U.S.C. 154(b) by 0 days.

(21) Appl. No.: 11/843,716

(22) Filed: Aug. 23, 2007

(51) Int. Cl.
*B24D 15/00* (2006.01)

(52) U.S. Cl. ..... 451/523; 451/524; 451/514

(58) Field of Classification Search ..... 451/512–515, 451/504, 506, 507, 523, 524, 490, 495, 311
See application file for complete search history.

(56) References Cited

U.S. PATENT DOCUMENTS

| | | | | |
|---|---|---|---|---|
| 2,270,835 | A | 1/1942 | Hibert | |
| 2,400,928 | A | 5/1946 | Hein | |
| 2,414,036 | A | 1/1947 | Gerhan | |
| 2,457,466 | A | 12/1948 | Hanna | |
| 2,761,257 | A | 9/1956 | Mendelsohn | |
| 3,063,208 | A | 11/1962 | Bell et al. | |
| 3,106,806 | A | 10/1963 | Hutchins | |
| 3,429,077 | A | 2/1969 | Grover | |
| 3,510,991 | A | 5/1970 | Bowen | |
| 3,601,933 | A * | 8/1971 | Bowen | 451/504 |
| 4,242,843 | A * | 1/1981 | Phillips | 451/512 |
| 4,478,011 | A * | 10/1984 | Russell | 451/492 |
| 4,640,060 | A | 2/1987 | Lukianoff | |
| 4,730,430 | A | 3/1988 | Petrovich | |
| 4,887,396 | A | 12/1989 | Lukianoff | |
| 5,172,524 | A | 12/1992 | Poss | |
| 5,383,308 | A | 1/1995 | Beloff et al. | |
| 5,387,251 | A | 2/1995 | Rouse | |
| 5,522,763 | A * | 6/1996 | Regnier | 451/502 |
| 5,720,654 | A | 2/1998 | Mac Donald | |
| 6,196,909 | B1 | 3/2001 | Cadrobbi | |
| 6,213,857 | B1 * | 4/2001 | Duquette | 451/513 |
| RE37,486 | E | 12/2001 | Stanzione | |
| 6,641,469 | B2 | 11/2003 | Deshler | |
| 6,663,479 | B2 | 12/2003 | Sendelbeck | |
| 6,835,124 | B2 | 12/2004 | Stephan | |
| 7,025,667 | B1 | 4/2006 | LaMarche | |
| 7,201,646 | B1 | 4/2007 | Patton | |

OTHER PUBLICATIONS

Sanddevil Web Page, Jan. 10, 2007.

* cited by examiner

*Primary Examiner*—Dung Van Nguyen
(74) *Attorney, Agent, or Firm*—McCormick, Paulding & Huber LLP

(57) ABSTRACT

A sanding block comprising slideably interrelated parts for accommodating an endless sanding belt and having a dual action means for selectively moving the parts into bearing relation with the sanding belt for maintaining tension thereon or moving the parts out of such bearing relation with the sanding belt for facilitating removal or adjustment of the sanding belt relative to the sanding block, while also providing the sanding block with a novel convexly curved surface for improved tool versatility.

8 Claims, 6 Drawing Sheets

SANDING BLOCK

FIELD OF THE INVENTION

The present invention relates to a sanding block comprising slideably interrelated sections or parts for accommodating an endless sanding belt and provided with means for adjusting the tension exerted by the sanding block on the sanding belt.

BACKGROUND OF THE INVENTION

A wide variety of sanding blocks comprising sections or parts for accommodating an endless sanding belt are shown in the prior art, with virtually all utilizing resilient means for holding the parts in spaced relation for maintaining tension on the sanding belt. However, most are limited in that release of that tension for removal of the sanding belt from the sanding block can be obtained only by manual compression together of the parts by the hands or fingers of the user.

In addition, while the sanding blocks of the prior art have flat lower and upper faces and small, curved or pointed ends for sanding flat and small curved or hard to reach surfaces, they lack a curved face for sanding larger curved surfaces.

Accordingly, a need exists for a means for selectively moving the parts of a sanding block into or out of bearing relation with a sanding belt for placing the sanding belt under tension or releasing tension from the sanding belt, while providing additional means for sanding larger curved surfaces.

SUMMARY OF THE INVENTION

A primary object of the invention is to provide a sanding block comprising slideably interrelated parts for accommodating an endless sanding belt and having dual action means for selectively moving the parts into bearing relation with the sanding belt for maintaining tension thereon or moving the parts out of such bearing relation with the sanding belt for facilitating removal or adjustment of the sanding belt relative to the sanding block.

A further object is the provision of such a sanding block which incorporates a convexly curved face for sanding larger curved surfaces.

DETAILED DESCRIPTION OF THE PREFERRED EMBODIMENT

Figure 1:
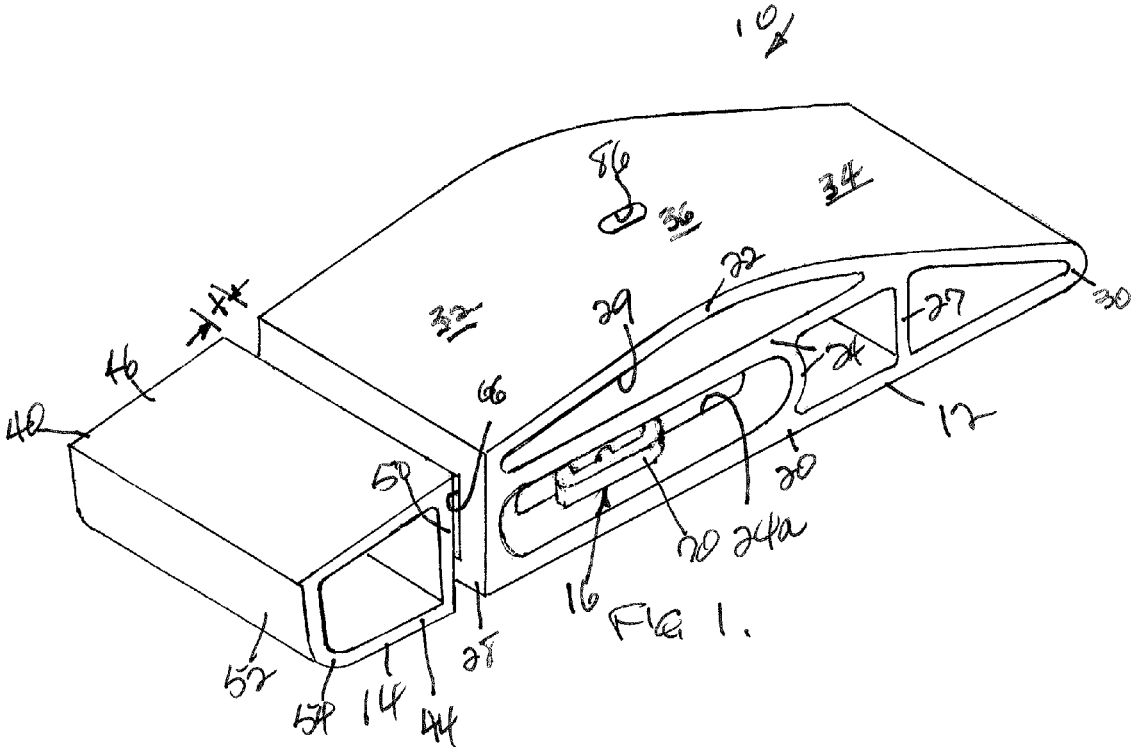
FIG. 1 is a front perspective view of a sanding block embodying a preferred form of the invention and including main and secondary parts and dual action means.
Figure 5:
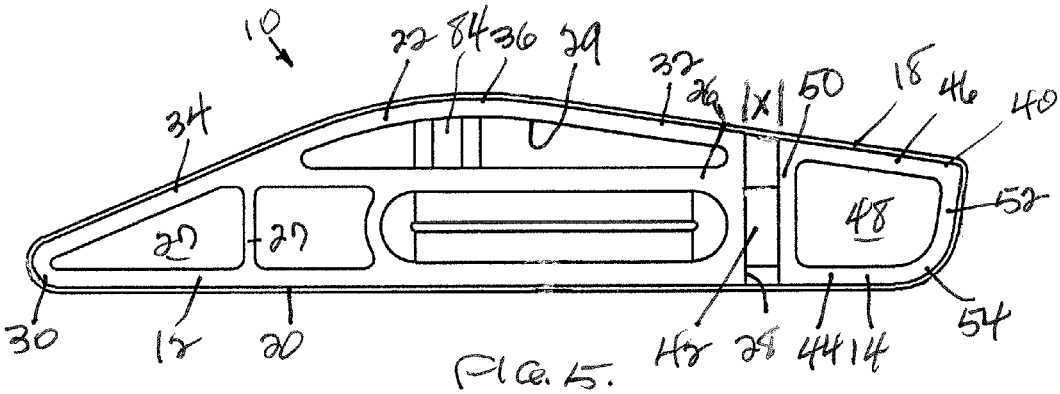
FIG. 5 is a rear side elevational view of the sanding block of FIG. 3.

The sanding block of the invention, which may be easily gripped by hand, is generally indicated by 10 and includes coaxially aligned, substantially rectangular, slideably interrelated main and secondary parts, 12 and 14 respectively, and dual action means, generally indicated by 16, all fabricated from any suitable strong, lightweight material, with the dual action means being mounted for pivotal movement within the main part 12 for effecting sliding longitudinal movement of the secondary part in opposite directions toward or away from the main part thereby adjusting the spacing between the main and secondary parts, as will appear.

An endless sanding belt 18 is provided and has appropriate contours to extend longitudinally around sanding block 10 in sleeving manner, with actuation of the dual action means effecting sliding movement of the sanding block secondary part between fully extended and fully retracted positions relative to the main part for varying the tension exerted on the sanding belt, thus permitting its easy adjustment on, or removal from the sanding block and facilitating mounting of a new sanding belt on the sanding block.

Sanding block main part 12 is preferably of greater length than that of secondary part 14 and includes spaced, substantially horizontally disposed, base and upper walls, 20 and 22 respectively, held in spaced relation by upright front and rear side-walls, 24 and 26 respectively, and cross bracing 27. Base wall 20 and upper wall 22 are joined at their inner ends by a flat, upright, inner end wall 28 and are joined at their outer ends by a curved, outer end wall 30 of reduced radius.

Longitudinally extending recesses 29 provided in front side-wall 24 and rear side-wall 26 of main part 12 permit the sanding block to be grasped by the thumb and fingers of a user.

Base wall 20 extends in a flat, horizontal plane, while upper wall 22 includes first and second oppositely inclined sections, 32 and 34 respectively, which merge at their opposite ends with a convexly curved midsection 36. First inclined section 32 inclines gently upwardly from upright inner end wall 28 to meet one end of curved midsection 36, while second inclined section 34 inclines sharply downwardly from the opposite end of curved midsection 36 to meet curved outer end wall 30.

The provision of a large, convexly curved area at the center of upper wall 22, and a small curved surface at the outer end of upper wall 22, permits use of sanding block 10 for sanding a wide variety of curved surfaces. Flat lower wall 20 also permits use of the sanding block for sanding flat surfaces.

Secondary part 14 of sanding block 10 includes a support section 40 for supporting sanding belt 18 and a slide section 42 which is fixed to support section 40 and extends horizontally outwardly therefrom for slideable engagement with main part 12.

Support section 40, which is of approximately equal transverse width to that of main part 12 of the sanding block, includes spaced, substantially horizontally disposed, base and upper walls, 44 and 46 respectively, held in spaced relation by cross bracing 48, best seen in FIGS. 6-10. Base wall 44 and upper wall 46 are joined at their inner ends by a flat, upright, inner end wall 50, which is of approximately equal height and transverse width to that of inner end wall 28 of main part 12, and are joined at their outer ends by an upright outer end wall 52 which extends substantially vertically downwardly from upper wall 46 and curves inwardly at its lower end at 54 at its juncture with base wall 44.

Upper wall 46 of secondary part 14 has a slight upward angle of inclination from outer end wall 52 to inner end wall 50 which matches the angle of inclination of first inclined section 32 of upper wall 22 of main part 12. Thus, when secondary part 14 and main part 12 are joined, a continuous, inclined surface is provided for supporting sanding belt 18, while surface 54 of the secondary part provides still another curved contour for supporting the sanding belt, thus adding further versatility to the sanding block.

Slide section 42 of secondary part 14 is drawer-like in appearance and includes spaced, parallel, upright, side-walls 56 and an upright outer end wall 58 which extends between and connects the outer ends of the side-walls. Side-walls 56 are fixed at their opposite ends to inner end wall 50 of support section 40. A bottom wall 60 extends horizontally from inner end wall 50 and underlies and is fixed to the lower ends of side-walls 56 and end wall 58.

A centrally located, horizontally extending slot 62 is cut through outer end wall 58 of slide section 42 and an upright post 64 is fixed to bottom wall 60 immediately rearwardly of the slot, all for purposes to be described.

Slide section 42 is slideably receivable through an appropriately sized, horizontally extending opening 66 in inner end wall 28 of major part 12 and into a cavity 68 provided in the interior of the major part on the upper surface of base wall 20. Cavity 68 extends inwardly between inner end wall 28 and an innermost transverse cross brace 27' and between front and rear side-walls, 24 and 26 respectively, of the major part.

Dual action means 16 is formed as a thin, substantially flat, integral unit which is mounted for rotation within cavity 68 of major part 12 and includes an arm 70, a cam means 72, a hook means, generally indicated by 74, and a hub 76, all emanating from a web 78.

Web 78 is substantially triangular in plan, with arm 70 extending outwardly from the apex of the triangle at an approximate right angle. Cam means 72 is convex and is formed at one end of the base of the triangle. Hook means 74 includes an L-shaped finger **74*a* which extends angularly outwardly from the base and defines a bend or crook 74*b* centrally of its length. Hub 76** is circular in plan and is formed at the opposite end of the base of the triangle.

Figure 2:
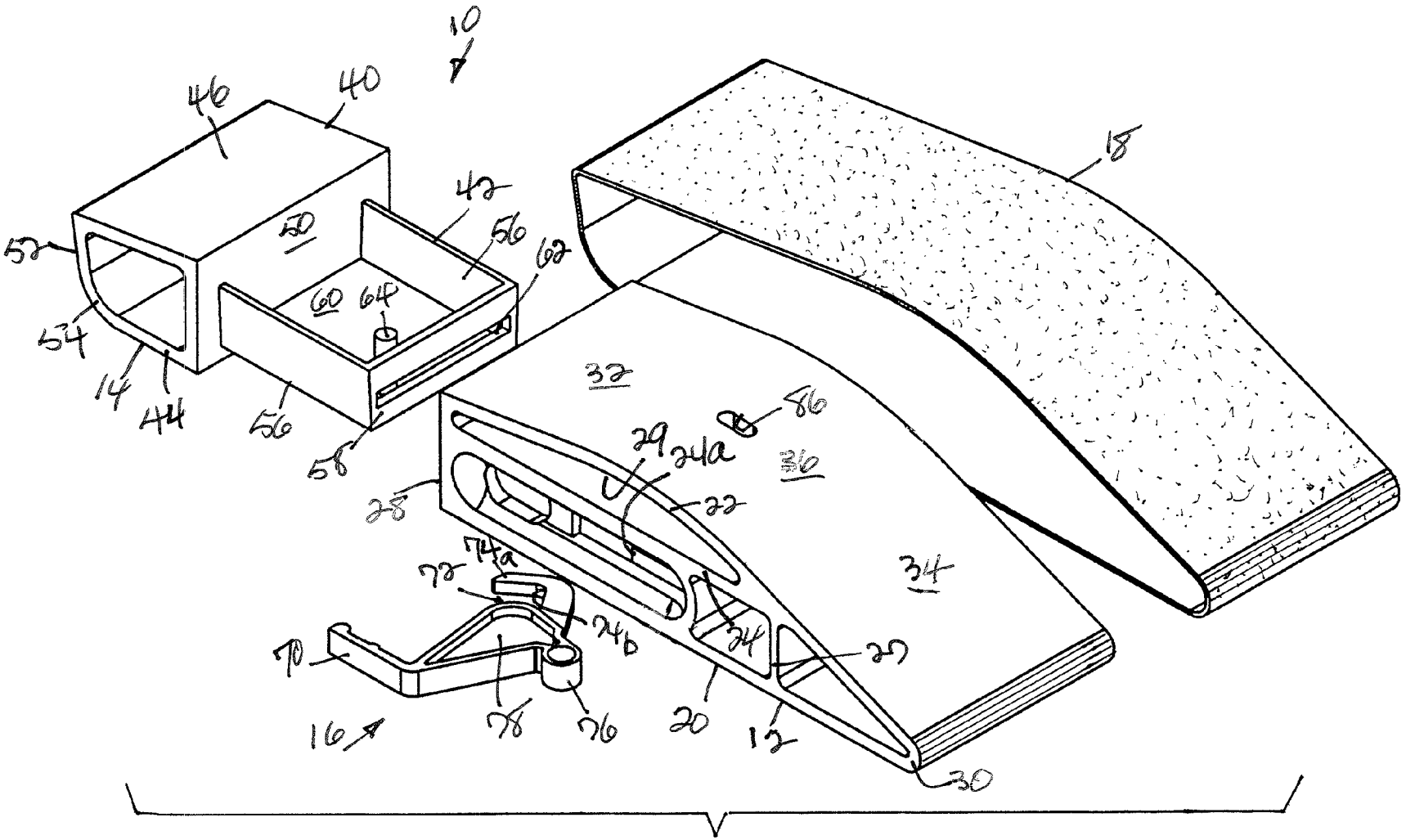
FIG. 2 is an exploded, perspective view of the sanding block of FIG. 1, with the main and secondary parts and the dual action means disassembled and shown in relation to a sanding belt of the endless type.
Figure 3:
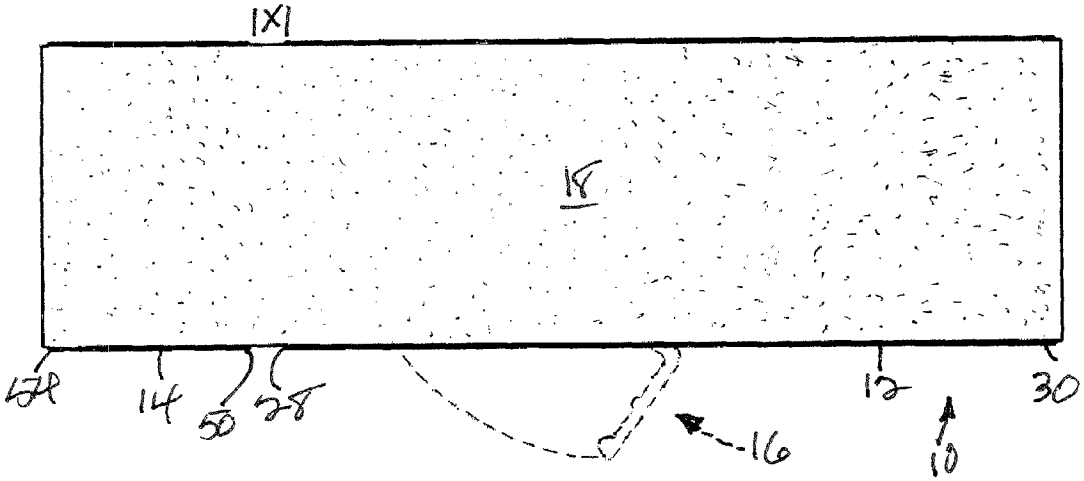
FIG. 3 is a top plan view of the sanding block of FIG. 1 with the sanding belt of FIG. 2 disposed thereon, and with the dual action means being shown in phantom in a fully opened position.
Figure 4:
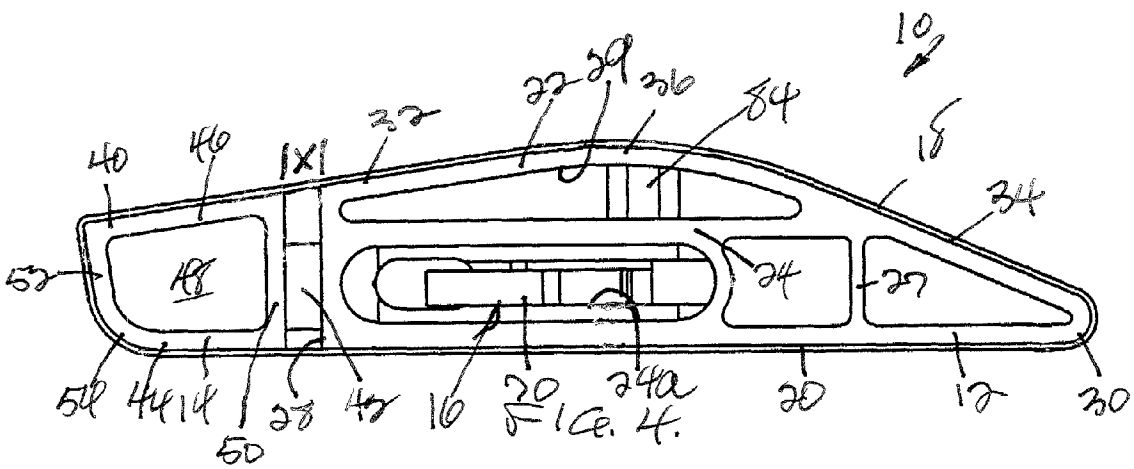
FIG. 4 is a front side elevational view of the sanding block of FIG. 3.
Figure 6:
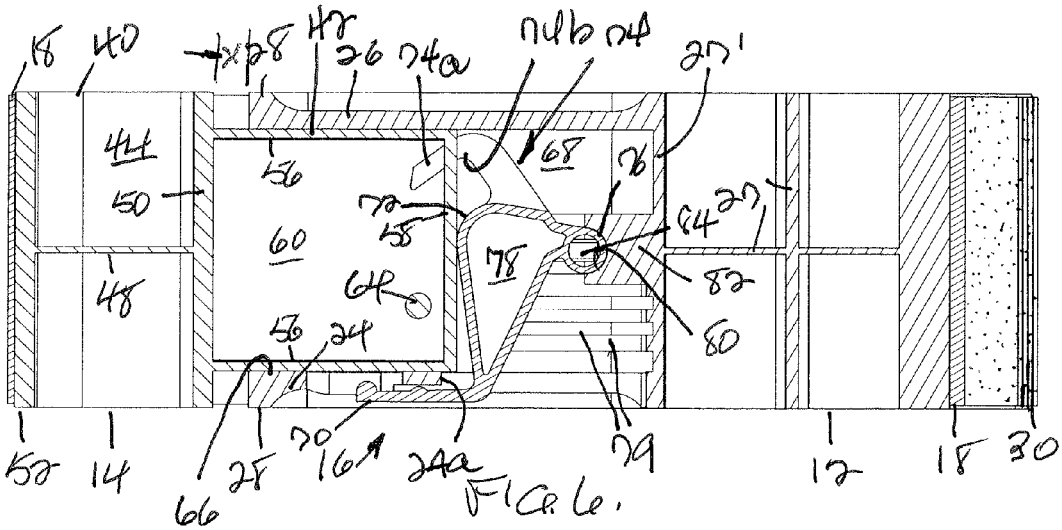
FIG. 6 is a cross sectional view taken longitudinally and centrally through the sanding block of FIG. 3 illustrating the dual action means in a fully closed position and with the main and secondary parts of the sanding block exerting full tension on the sanding belt.
Figure 7:
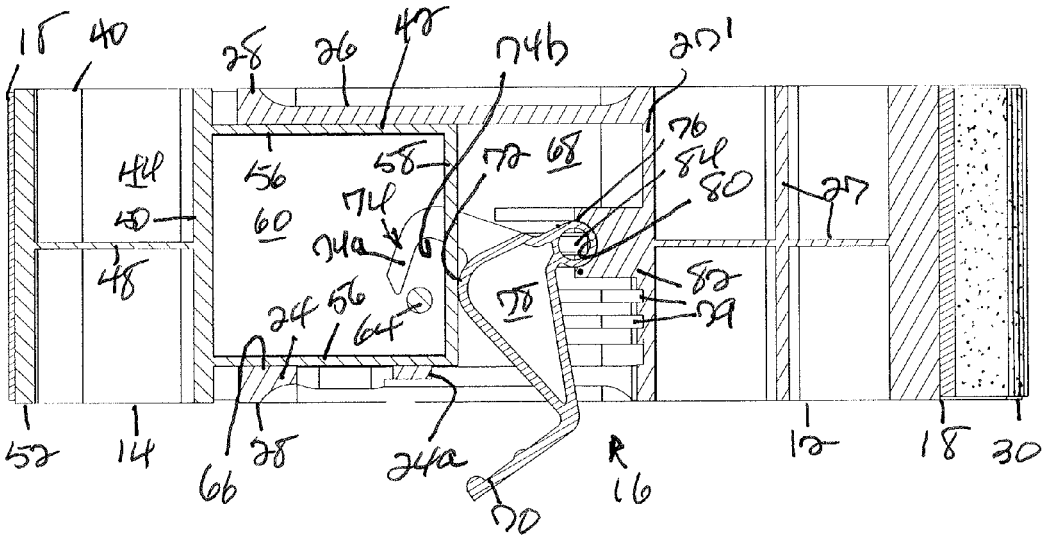
FIG. 7 is a cross sectional view similar to FIG. 6 illustrating the dual action means in a first partially opened position and with the main and secondary parts of the sanding block exerting partial tension on the sanding belt.

With dual action means 16 oriented as shown in FIG. 2, it is inserted into major part 12 through an opening **24*a* in front side wall 24 of the major part so that hook means 74, cam means 72, hub 76 and web 78 are disposed in cavity 68, with web 78 being supported on a series of spaced, upright ribs 79 provided on the upper surface of main part bottom wall 20 and with arm 70 being disposed immediately outwardly of opening 24*a*, in spaced parallelism to, and in abutting relation to front side wall 24, as shown in FIGS. 1 and 6**.

Upon insertion of dual action means 16 into major part 12, hub 76 is receivable in a semi-circular cutout 80 provided in an abutment 82 disposed centrally of innermost cross brace 27'. Hub 76 is rotatable relative to cutout 80 and relative to an upright pivot member 84 which extends vertically between abutment 82 and upper wall 22 of main part 12, with the pivot member being inserted into the main part through an opening 86 provided in upper wall 22.

Slide section 42 of secondary part 14 is of such length that when it is slid into cavity 68 of major part 12 its outer end wall 58 is positioned immediately forwardly of dual action means 16, which is of such size and configuration that finger **74*a* of hook means 74 thereof extends freely into and through slot 62 in outer end wall 58, while cam means 72 thereof contacts the outer face of outer end wall 58**.

Figure 9:
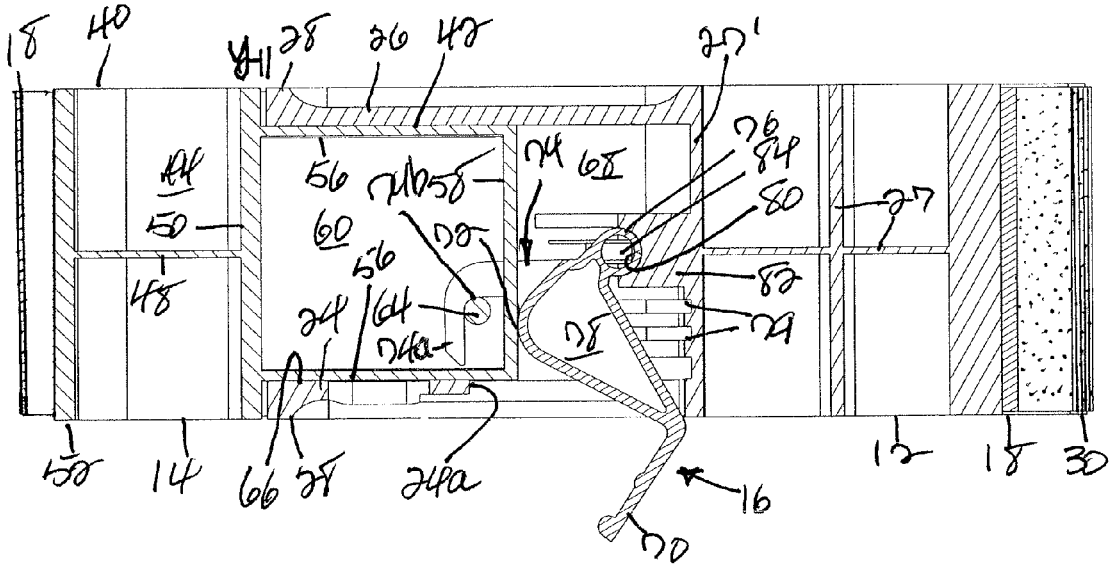
FIG. 9 is a cross sectional view similar to FIG. 6 illustrating the dual action means in a fully opened position and with the main and secondary parts of the sanding block exerting no tension on the sanding belt.
Figure 10:
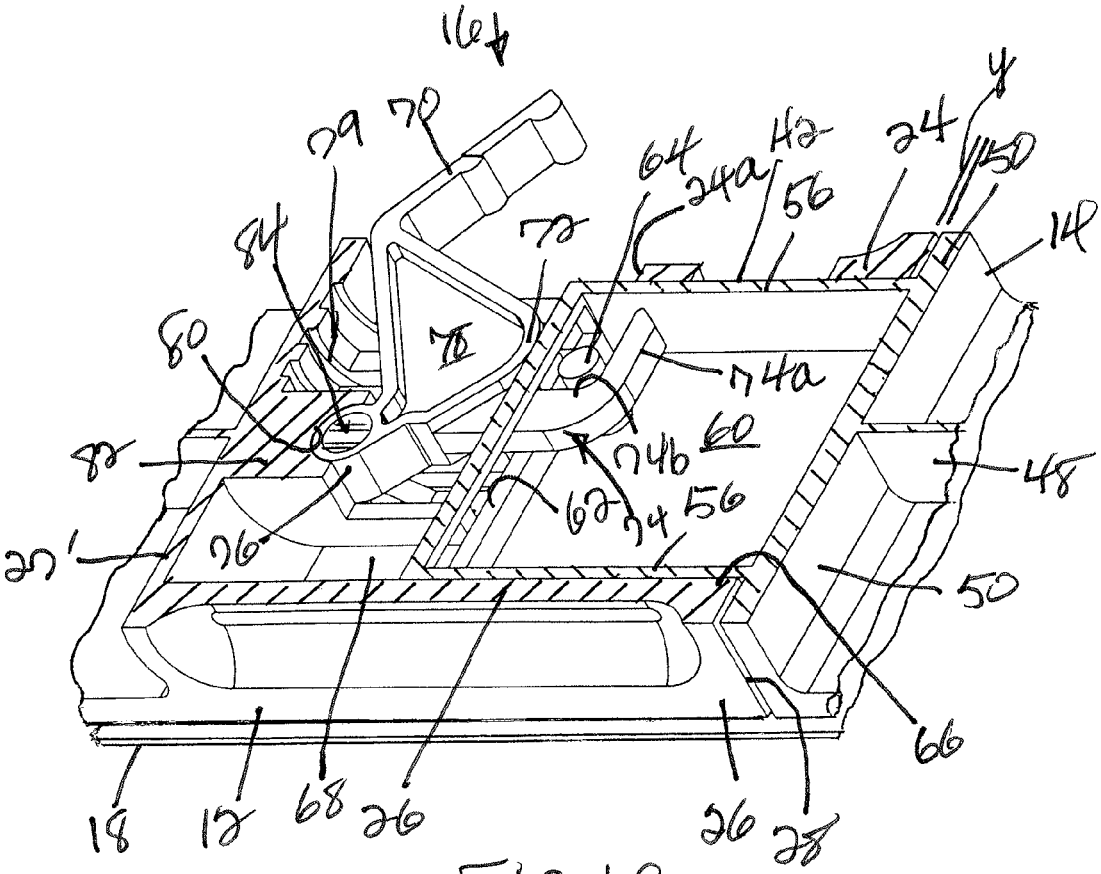
FIG. 10 is an enlarged, fragmentary, cross sectional, perspective view illustrating the relationship between the dual action means, the main and secondary parts of the sanding block and the sanding belt in the fully opened position of the dual action means.

Dual action means 16 may be actuated by grasping arm 70 by the fingers of the user and moving the arm between the fully closed position of FIGS. 1-6, wherein main part 12 and secondary part 14 of the sanding block are widely spaced apart longitudinally, as indicated by the letter x, to impart full tension on sanding belt 18, and the fully opened position of FIGS. 9 and 10 wherein the main part and secondary parts of the sanding block are closely spaced longitudinally, as indicated by the letter y, to release tension on the sanding belt.

Figure 8:
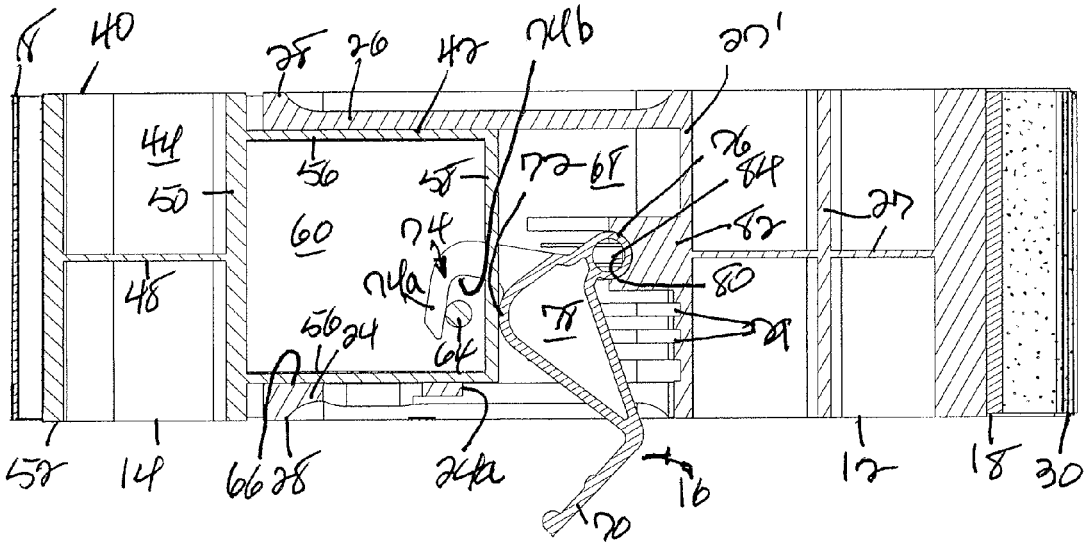
FIG. 8 is a cross sectional view similar to FIG. 6 illustrating the dual action means in a second partially opened position and with the main and secondary parts of the sanding block exerting still less tension on the sanding belt.

Movement of the arm 70 in a counter-clockwise direction from the fully closed position of FIG. 6 to the partially opened position of FIG. 8 causes dual action means 16 to rotate on pivot member 84 to bring finger **74*a* of hook means 74 into contact with post 64 in slide section 42 of secondary part 14. Continued counter-clockwise rotation of the dual action means to the fully opened position of FIGS. 9 and 10 causes the hook finger 74*a* to exert an inward pulling force on the post thereby setting up a concomitant inward pulling force on the slide section for moving the secondary part inwardly. This inwardly directed force also brings inner end wall 50 of the secondary part and inner end wall 28 of main part 12 into close proximity, separated only by the distance y. Outer end wall 52 of the secondary part is also moved out of engagement with sanding belt 18 whereby tension on the sanding belt is removed to permit its adjustment or removal from sanding block 10**.

In the fully opened position of arm 70, post 64 is locked in bend or crook **74*b* of hook means 74 for blocking further longitudinal movement of the main and secondary parts of the sanding block relative to each other, whereby removal of the sanding belt 18** from the sanding block, or its adjustment relative to the sanding block, or the mounting of a new sanding belt upon the sanding block is facilitated.

Rotation of the arm 70 from the fully opened position to the fully closed position moves bend **74*a* of hook means 74 out of contact with post 64, with cam means 72 exerting an outward pushing force on outer end wall 58 of secondary part 14 for moving the secondary part outwardly and moving end wall 50 of the secondary part away from inner wall 28 of main part 12 for the distance x, whereby end wall 52 of the secondary part is moved into tight engagement with sanding belt 18** to place the sanding belt under maximum tension.

It will be apparent from the foregoing that applicant has provided a sanding block comprising slideably interrelated parts for accommodating an endless sanding belt and having novel dual action means for selectively moving the parts into bearing relation with the sanding belt for maintaining tension thereon or moving the parts out of such bearing relation with the sanding belt for facilitating removal or adjustment of the sanding belt relative to the sanding block, while also providing the sanding block with a novel convexly curved surface for improved tool versatility.

What is claimed is:

1. A sanding block comprising: slideably interrelated main and secondary parts, dual action means disposed between the main and secondary parts and adapted to selectively move one of the parts toward or away from the other part;

wherein the sanding block accommodates an endless sanding belt;

wherein the dual action means has cam means selectively engageable with one of the parts for effecting movement of said part in a first direction and hook means selectively engageable with said one of the parts for effecting its movement in an opposite direction; and wherein the hook means is selectively engageable with said one of the parts for blocking its movement.

2. A sanding block according to claim 1, wherein the dual action means is mounted for rotation relative to one of the parts and wherein appropriate rotation of the dual action means selectively moves the main and secondary parts into and out of bearing relation with the sanding belt.

3. A sanding block comprising: a main part and a secondary part slideably interrelated for accommodating an endless sanding belt and dual action means mounted for rotation relative to the main part and for contact with the secondary part, the dual action means being so positioned between the main and secondary parts as selectively to move the secondary part toward the main part upon rotation of the dual action means in a first direction and to move the secondary part in an opposite direction away from the main part upon rotation of the dual action means in an opposite direction;

wherein the dual action means includes cam means selectively engageable with the secondary part for effecting movement of the secondary part in the first direction and hook means selectively engageable with the secondary part for effecting movement of the secondary part in the opposite direction; and wherein the hook means comprises a hook finger which extends through an opening in the secondary part, the hook finger having a bend or crook which is selectively engageable with a post in the secondary part.

4. A sanding block according to claim 3, wherein appropriate rotation of the dual action means selectively moves the main and secondary parts into and out of bearing relation with the sanding belt.

5. A sanding block according to claim 3, wherein the main part has upper and lower faces, one of which is flat and the other of which is convexly curved centrally of its length.

6. A method for effecting relative movement of the parts of a sanding block having slideably interrelated main and a secondary parts for accommodating an endless sanding belt comprising the steps of: positioning a dual action means between the main and secondary parts for rotation upon the main part and contact with the secondary part, rotating the dual action means in a first direction thereby effecting movement of the secondary part in a first direction and, rotating the dual action means in an opposite direction, thereby effecting movement of the secondary part in an opposite direction, wherein said dual action means includes cam means which is selectively engageable with the secondary part for effecting its movement in a first direction and hook means which is selectively engageable with the secondary part for effecting its movement in an opposite direction.

7. The method of claim 6, wherein appropriate rotation of the dual action means selectively moves the main and secondary parts into and out of bearing relation with the sanding belt.

8. The method of claim 6, wherein the main part has upper and lower faces, one of which is flat and the other of which is convexly curved centrally of its length.

* * * * *